US005167776A

United States Patent [19]

Bhaskar et al.

[11] Patent Number: 5,167,776

[45] Date of Patent: Dec. 1, 1992

[54] THERMAL INKJET PRINTHEAD ORIFICE PLATE AND METHOD OF MANUFACTURE

[75] Inventors: Eldurkar Bhaskar; Marzio Leban; Kenneth E. Trueba, all of Corvallis, Oreg.

[73] Assignee: Hewlett-Packard Company, Palo Alto, Calif.

[21] Appl. No.: 686,077

[22] Filed: Apr. 16, 1991

[51] Int. Cl.[5] ..... C25D 1/08

[52] U.S. Cl. ..... 205/75

[58] Field of Search ..... 205/75

[56] References Cited

U.S. PATENT DOCUMENTS 4,374,707 2/1983 Pollack ..... 205/75

*Primary Examiner*—T. M. Tufariello

[57] ABSTRACT

A new and improved orifice or nozzle plate for an inkjet printhead and method of manufacture wherein the orifice or nozzle plate thickness has been increased significantly to a value on the order of 75 micrometers or greater while simultaneously maintaining the integrity of the convergent contour of the multiple orifice openings formed therein. In a first embodiment of this invention, metal layer stacking through the use of successive electroforming processes is used to achieve a desired orifice plate structure, architecture and convergent orifice geometry. In a second embodiment of this invention, anisotropic electroplating on a metal surface and over the edges of an inorganic dielectric mask is used to produce this orifice plate of increased orifice bore thickness and convergent orifice bore geometry. In yet a third embodiment of the invention, a selected metal is plated upon a permanent insulating mandrel having a metal pattern thereon to form convergent orifice openings in the plated metal. Openings are then formed in the insulating layer which are aligned with electroplated convergent openings in the metal layer to thereby form a composite metal-insulator orifice plate of increased thickness and overall convergent orifice bore geometry.

11 Claims, 5 Drawing Sheets

THERMAL INKJET PRINTHEAD ORIFICE PLATE AND METHOD OF MANUFACTURE

TECHNICAL FIELD

This invention relates generally to the manufacture of orifice plates for inkjet pens and more particularly to the fabrication of such orifice plates having an increased thickness and an orifice opening convergent geometry to improve print quality performance.

BACKGROUND ART

In the manufacture of thin film printheads for thermal inkjet pens, it has been a common practice to align and bond a metal orifice plate to an adjacent thin film resistor substrate using an adhesive barrier insulating material such as Vacrel TM sold by the DuPont Company of Wilmington, Delaware. It has also been a common practice to photolithographically define a plurality of ink firing chambers and ink feed channels in the Vacrel TM layer so that each firing chamber therein is aligned with respect to each heater resistor on an underlying thin film resistor substrate and to an orifice opening or group of openings in the adjacent orifice plate. In this manner, the heater resistors may be electrically driven as is well known to heat the ink within each of the firing chambers to boiling and thus cause the ink to be ejected from the orifice openings in the orifice plate and onto an adjacent print medium.

In the past, it has been a common practice to use electroforming processes to electroplate the orifice plate member into a desired geometry before being transported to an orifice plate attachment station. At this location these orifice or nozzle plates are first optically aligned with the thin film resistor substrate and barrier layer thereon and then adhesively bonded to the Vacrel TM barrier layer so that the orifice openings in the electroformed orifice plate are precisely aligned with respect to the heater resistors on the thin film resistor substrate. Various types of electroforming processes have been used in the past in the formation of these orifice plates and are disclosed, for example, in U.S. Pat. No. 4,773,971 issued to Si Ty Lam et al, in U.S. Pat. No. 4,675,083 issued to James G. Bearss et al and in U.S. Pat. No. 4,694,308 issued to C. S. Chan et al. All of these above identified patents are assigned to the present assignee and are incorporated herein by reference.

It has also been a common practice to electroplate these orifice plates on a metal surface and up and over the edges of insulating regions or islands on the metal surface so as to form orifice openings having contours which converge toward the surfaces of these insulating regions or islands. These orifice openings normally converge from a large orifice opening at the back of the orifice plate and smoothly into a smaller orifice opening at the front or ink ejection surface of the orifice plate. As is also well known, the preference for using a convergent geometry orifice opening of this type in the fabrication of thermal inkjet printheads is to minimize "gulping" within the orifice plate and adjacent ink firing chambers and thereby in turn reduce cavitation wear on the thermal inkjet printhead heater resistors during the firing of the inkjet pen. A further and more detailed discussion of this problem of gulping and cavitation wear on the heater resistors may be found in the above commonly assigned U.S. Pat. No. 4,694,308 issued to C. S. Chan et al.

Various types of orifice plate alignment and thin film resistor substrate attachment processes and procedures are also disclosed generally in the above referenced patents and are disclosed in more process-related detail describing the overall thin film printhead fabrication techniques and printhead architecture in the *Hewlett Packard Journal,* Volume 16, No. 5, published May 1985, and also in the *Hewlett Packard Journal,* Volume 39, No. 4, published August 1988, both incorporated herein by reference.

The orifice plate fabrication process being currently used by the present assignee is disclosed in the above identified U.S. Pat. No. 4,773,971 issued to Si Ty Lam et al and also in a copending application Ser. No. 07/236,890 of Si Ty Lam et al which is a continuation application of U.S. Pat. No. 4,773,971. This issued patent and continuation application of Si Ty Lam et al both disclose electroplating processes for forming thermal inkjet printhead orifice plates wherein various metals are electroformed on selected substrates. These selected substrates or mandrels are grouped into one class comprising selected metal patterns formed on an underlying insulating layer or substrate and in another class comprising selected insulating patterns formed on an underlying metal layer or substrate. Of particular interest in these Lam et al electroforming processes for making these precision architecture orifice plates is an orifice plate fabrication process wherein a durable inorganic dielectric pattern such as silicon carbide, SiC, is formed on an underlying layer of stainless steel which in turn is supported by a thick glass or quartz plate.

Whereas the above orifice plates produced by the electroforming processes disclosed in the above identified U.S. Pat. No. 4,773,971 and copending application Ser. No. 07/236,890 of Si Ty Lam et al have proven to be highly regarded and commercially successful and superior in most aspects of their operational performance, and whereas these Si Ty Lam electroforming processes are capable of producing high precision architecture orifice plates with closely controlled orifice diameters and center-to-center orifice spacings, there are nevertheless certain applications where it is desired to increase the thickness of these orifice plates in order to increase the thickness of the orifice bores therein. This requirement is necessary in certain applications in order to decrease the ink drop spray which is sometimes caused when the "tail" of an ejected drop of ink is swept against one side of a convergent orifice opening as the ink drop is ejected from the outer or ink ejection orifice surface of a thermal inkjet thin film resistor-type printhead. This ink spraying effect is particularly evident in thermal inkjet printhead designs and architectures wherein the heater resistors of the thin film resistor substrate are offset slightly with respect to the orifice opening center line. This heater resistor offset is used in order to compensate for directionality errors which will otherwise occur when the heater resistors are precisely aligned with respect to these orifice opening center lines. This ink drop spray effect in turn produces a visible edge roughness where the ink drop or dot is deposited on an adjacent print medium, and this edge roughness in turn degrades the resolution and print quality of the printed media.

DISCLOSURE OF INVENTION

The general purpose and principal object of the present invention is to provide a new and improved thermal inkjet orifice plate architecture and method of manufacture wherein these orifice plates are operative to provide a significant improvement in print quality performance and resolution of the inkjet printed media.

Another object of this invention is to minimize and substantially eliminate the above problem of ink drop spray and thereby in turn minimize and substantially eliminate visible edge roughness of dots printed on an adjacent printed media.

Another object of this invention is to provide a new and improved orifice plate fabrication process useful in the manufacture of thermal inkjet printheads which utilizes existing technologies to produce orifice plates and associated printhead structures which are reliable in operation and which may be economically manufactured at relatively high yields.

A feature of this invention is the provision of a new and improved orifice plate of the type described whose thickness has been significantly increased relative to prior art orifice plate designs while simultaneously maintaining good smooth convergence in the geometry of the orifice openings developed in the orifice plate.

Another feature of this invention is the provision of a new and improved orifice plate of the type described wherein good smooth convergent orifice opening geometries are achieved by electroforming stacked multiple metal layers on a removable and reusable mandrel and having aligned convergent orifice openings in each of the adjacent metal layers which together define composite convergent orifice openings in the completed orifice plate structure.

Another feature of this invention is the provision of a new and improved thermal inkjet orifice plate of the type described wherein the good smooth convergent orifice opening geometry is achieved in a different method by the use of anisotropic plating of the orifice plate on an underlying substrate or mandrel. Using this method, the orifice plate thickness or vertical plating occurs at a higher rate than its lateral plating to thereby maintain good smooth convergent geometries at the orifice openings therein.

Another feature of this invention is the provision of a new and improved orifice plate fabrication process of the type described wherein enhanced orifice plate thickness is achieved by the fabrication of a metal layer-insulating layer composite structure. In this novel structure, the insulating layer is multi-functional in purpose in that it not only provides an integral part of the completed orifice plate thus formed, but it further serves as a permanent mandrel used in the electroplating of the metal layer portion of the composite orifice plate.

In a first, multiple layer electroforming process embodiment according to the present invention, the above objects and related advantages are achieved by the steps of:

a. providing a mandrel having a surface area thereon comprised of conductive and insulating regions, b. electroforming a first metal layer on the mandrel surface area and on the conductive regions thereon and extending over the edges of the insulating regions of the mandrel to form convergent orifice openings therein located on top of the insulating regions, c. forming an insulating pattern on top of the first metal layer so that insulating sections or islands within the insulating pattern overlie and are approximately laterally coextensive with the insulating regions of the mandrel, and d. electroforming a second metal layer on top of the first metal layer and extending over the edges of the insulating section or islands of the insulating pattern to form convergent orifice openings within the second metal layer which are aligned with the convergent orifice openings in the first metal layer, whereby the aligned convergent orifice openings in the first and second metal layers preserve and form an overall orifice opening convergent contour extending from an outer surface of the first metal layer to an outer surface of the second metal layer.

In a second, anisotropic plating embodiment of this invention, the above objects and related advantages are achieved by the steps of:

a. providing a mandrel having a surface area thereon comprised of conductive and insulating regions, b. electroplating a metal layer on the conductive regions of the mandrel and over the edges of the insulating regions thereon to thereby form convergent orifice openings atop the insulating regions, and c. anisotropically plating the metal layer at a vertical or layer thickness rate which is greater than the plating rate in the lateral direction perpendicular to the vertical or thickness dimension, whereby metal orifice plate layer thicknesses on the order of 75 micrometers or greater are achieved simultaneously with the production of convergent orifice opening geometries.

In a third embodiment of the present invention, the above objects and related advantages are achieved by the steps of:

a. providing an insulating substrate having a metal pattern thereon, b. electroplating a metal over the surfaces of the metal pattern and into contact with an exposed surface of the insulating substrate to form convergent orifice openings in the electroplated metal layer, and c. creating openings in the insulating substrate which are aligned with the convergent orifice openings in the metal orifice plate layer to thereby extend the opening convergence and contour of the metal orifice plate layer from one side of the insulating substrate to the other, whereby the insulating substrate and adjacent metal orifice plate layer form a composite metal-insulator orifice plate structure capable of being formed to a total thickness on the order of 75 micrometers or greater.

The above brief summary of the invention, together with its various objects, features, and attendant advantages will become better understood with reference to the following description of the accompanying drawings.

Figure 2A:
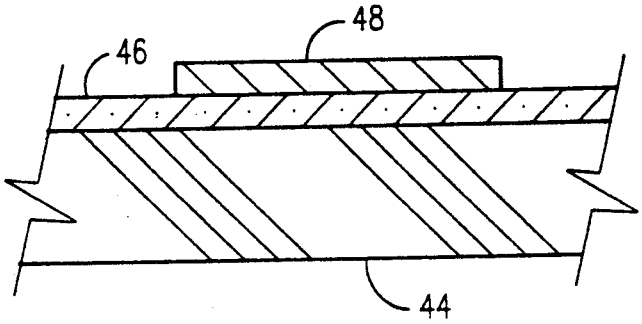
FIGS. 2A and 2B are abbreviated schematic cross-section views illustrating a second embodiment of the invention wherein anisotropic plating is utilized to form the novel metal orifice plate described herein.
Figure 2B:
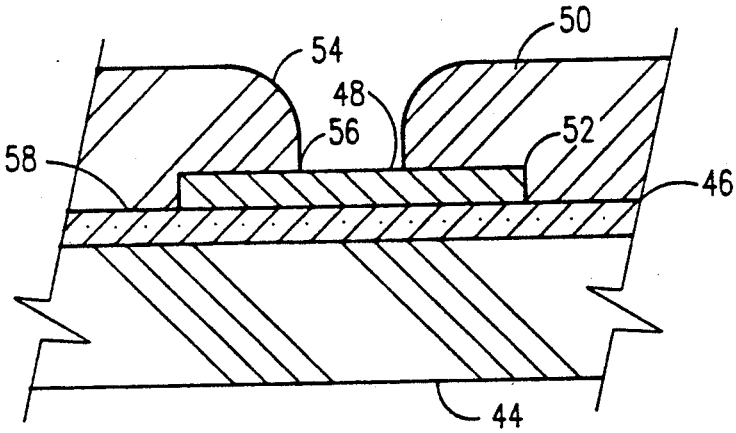
Figure 3A:
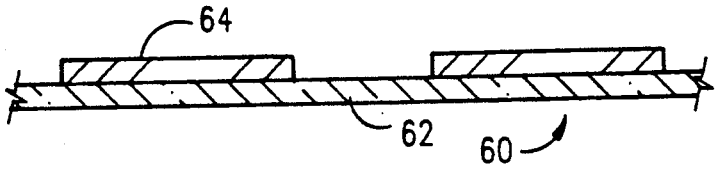
FIGS. 3A, 3B and 3C are abbreviated schematic cross-section views illustrating a third embodiment of the invention wherein a composite metal layer-insulating layer orifice plate structure is formed using the insulating layer as a permanent mandrel and integral part of the composite orifice plate structure thus formed.
Figure 3B:
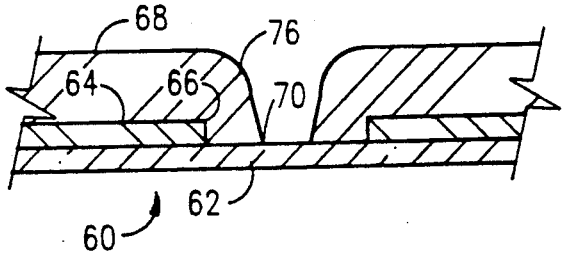
Figure 3C:
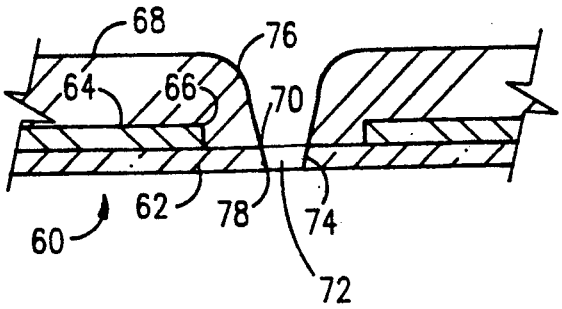

Although only a single convergent orifice plate opening is shown in FIGS. 2A and 2B and in FIGS. 3A through 3C, it is to be understood that these openings are merely representative of a larger plurality of orifice openings which may be arranged in any desired geometry, such as in circular primitives, angled rows and columns and the like.

DETAILED DESCRIPTION OF THE PREFERRED EMBODIMENT

Figure 1A:
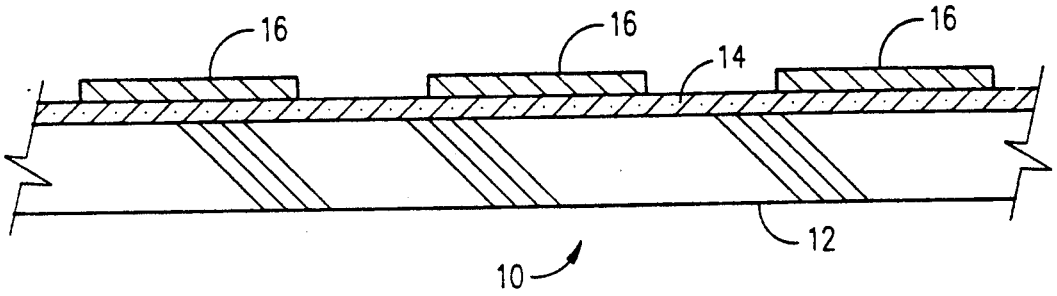
FIGS. 1A through 1E are a series of abbreviated schematic cross-sectional views illustrating the sequence of process steps used in a first embodiment of the invention.

Referring now to FIG. 1A, there is shown a reusable mandrel which is designated generally as 10 and includes a main supporting substrate 12 which will typically be either a glass or quartz plate having a thickness on the order of 90–120 mils and having a thin layer 14 of sputtered stainless steel deposited on the upper surface thereof. A surface pattern 16 of a selected inorganic dielectric material such as silicon carbide, SiC, is formed as shown as an electroplating mask on the upper surface of the stainless steel layer 14 and thus in effect forms a three layered reusable mandrel structure upon which the first electroplating step is carried out to form a first orifice plate layer 18 in accordance with the present invention as described below.

Figure 1B:
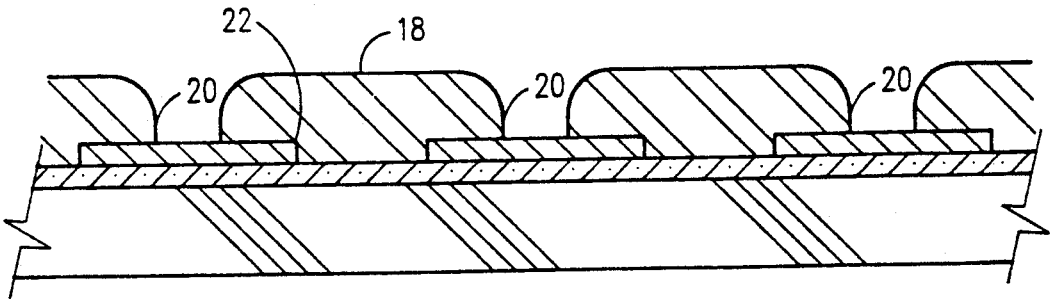

Referring now to FIG. 1B, the mandrel 10 is transferred to an electroforming station where a selected metal such as nickel is electroplated in the geometry shown to form a first orifice plate layer 18 having a plurality of convergent orifice or nozzle openings 20 therein which are defined by electroplating the nickel up and over the edges 22 of the plurality of inorganic insulating islands or regions 16. The first nickel layer 18 will typically be plated to a thickness on the order of about 50 micrometers.

Figure 1C:
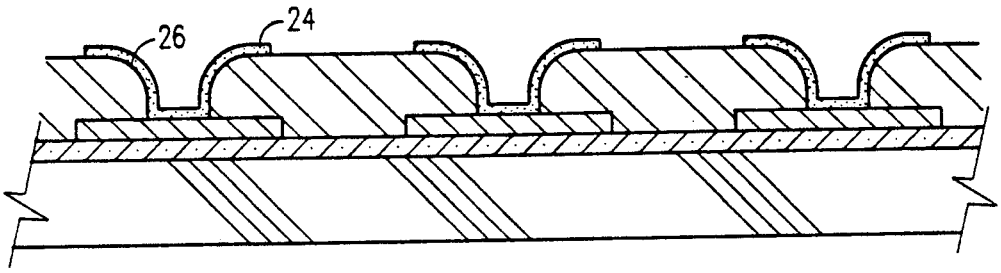

Referring now to FIG. 1C, a suitable insulating pattern 24 such as photoresist is formed in the geometry shown with the photoresist islands 24 being positioned and centrally aligned in the orifice openings 20 in the layer 18 and extending up and over the convergent edges 26 of the first electroplated nickel layer 18. These photoresist islands 24 are approximately laterally coextensive with the lateral dimensions of the silicon carbide insulating islands 16 disposed on the stainless steel surface layer 14 as previously described. The photoresist islands 24 will typically be about 2 micrometers in thickness and will be of either the same lateral dimension or either slightly greater or slightly smaller than the lateral dimension the silicon carbide discs 16.

Figure 1D:
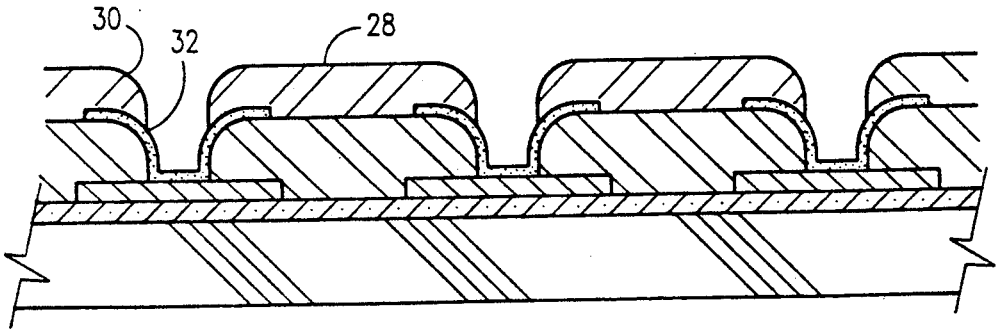

Referring now to FIG. 1D, the structure shown in FIG. 1C is transferred to an electroforming or electroplating station wherein a second metal layer 28, also of nickel, is electroplated on top of the first metal layer 18 and up and over the outer edges of the photoresist pattern 24. The second layer 28 of electroplated nickel also has a convergent contour 30 at the orifice openings thus formed, and these convergent orifice openings extend down into a point of contact 32 with the photoresist islands 24. If desired, the process illustrated in FIG. 1D herein may be further extended to include three electroplated layers (not shown) rather than the two layers shown in the figures.

Figure 1E:
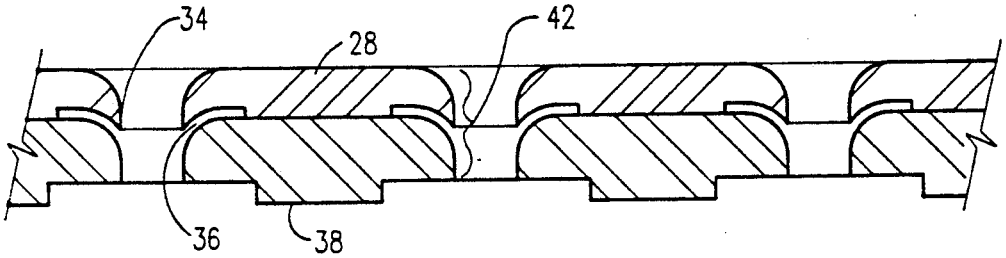

Referring now to FIG. 1E, the double layer plated structure shown in FIG. 1D is transferred to a suitable soak solvent etching station wherein the photoresist pattern 24 is removed to leave the "bird beak" geometry 34 as shown and having the recessed cavities 36 which extend upwardly in the contour as shown between the first and second electroplated layers 18 and 28 of nickel. The second layer 28 of nickel will typically be plated to a thickness of between 30 and 50 micrometers to thereby extend the total thickness of the composite orifice plate structure shown therein to a thickness of between 80 and 100 micrometers. The composite orifice plate structure shown in FIG. 1E has been further treated to remove the mandrel 10 including the glass substrate 12, the stainless steel sputtered layer 14, and the lower silicon carbide islands 40 from the lower surface 38 of the structure. This composite orifice plate shown in FIG. 1E has the desired overall convergent orifice contour indicated generally by reference number 42, and with the small orifice diameters typically on the order of 20–50 micrometers and with orifice center-to-center spacings typically on the order of 80–180 micrometers.

Thermal inkjet pens have been built using the orifice plate structure shown in FIG. 1E, and the print quality of the print sample generated by such pens was excellent. These samples exhibited a negligible amount of edge roughness as a result of the undesirable ink spray which has previously been observed in the use of the prior art pens described above.

Referring now to FIGS. 2A and 2B, there is shown a second embodiment of the present invention wherein anisotropic electroplating is used as an alternative embodiment to the metal layer stacking process described above with reference to FIGS. 1A through 1E. In FIG. 2A, there is shown a glass plate or substrate 44 upon which a surface layer 46 of stainless steel has been sputtered deposited. A mask pattern 48 of a selected inorganic dielectric material such as silicon carbide has been deposited as shown on the surface of the stainless steel layer 46 using known masking and inorganic materials deposition techniques. The composite reusable mandrel consisting of glass, steel and inorganic dielectric materials 44, 46, and 48 is then transferred to an anisotropic plating station wherein a thick layer 50 of nickel is plated up and over the edges 52 of the silicon carbide discs or islands 48.

The electroplating rate in the vertical or thickness dimension of the metal plate 50 may be made to be significantly greater than the electroplating rate in the lateral or width dimension of the orifice plate 50. This technique is useful to generate the convergent orifice bore geometry in the orifice plates being fabricated. One technique which has been proposed to accomplish this anisotropic electroplating is to first dilute the electroplating solution to about six (6) ounces per gallon of total nickel content and to reduce the electroplating current to a level which is sufficiently low to avoid burning. Then, a water soluble polymer such as a high molecular weight polyvinyl alcohol or a polyethylene glycol should be added to the electroplating solution so that it is operative to reduce the diffusion of nickel ions substantially to the upper surface areas of the metal being plated and minimize the electroplating rate in the orifice bores.

Another suitable Watts Nickel solution which has been proposed for this anisotropic plating would include the use of dilute nickel sulfate, $NiSO_4\ 6H_2O$, of twenty-two (22) ounces per gallon of electroplating bath; nickel chloride, $NiCl_6$ in twelve ounces per gallon of electroplating bath and six (6) ounces of boric acid per gallon of electroplating bath. Then, by agitating the solution this has the effect of supplying more nickel ions to the top surfaces of the nickel being electroplated and simultaneously it reduces the nickel ion concentration in the orifice bore region. The current density, agitation rate and electroplating temperature may be varied by those skilled in the art to arrive at a desired or optimum vertical-to-lateral nickel electroplating rate for ultimately producing the desired embodiment as shown in FIG. 2B.

The solution temperature should be set somewhere in the range of 35°–40° C. Using this process, an orifice plate 50 may be expected to plate up to a thickness of about 75 micrometers or greater while simultaneously maintaining the integrity of the smooth convergent contour 54 of the orifice openings thus formed which terminate at a point of contact 56 on the surfaces of the silicon carbide islands 48.

Once the electroplating process used to form the nickel layer 50 has been completed, the reusable mandrel consisting of layers 44, 46, and 48 is peeled away from the lower surface 58 of the nickel layer 50 to thereby leave the orifice plate 50 intact and ready for transfer to an orifice plate alignment and attachment station for securing the orifice plate to a thin film heater resistor substrate and barrier layer (not shown). If greater orifice plate thicknesses are desired, additional layers of metal may be electroplated as described above with reference to FIGS. 1A–1E.

Referring in sequence now to FIGS. 3A, 3B, and 3C there is shown in FIG. 3A a permanent mandrel which is identified generally as 60 and includes a polyimide or other suitable substrate material 62 which is formed to a thickness typically on the order of about 25 micrometers. A metal pattern 64 having a plurality of openings 66 therein is deposited on the upper surface of the polyimide substrate 62, and the metal pattern 64 will typically be a material such as copper deposited to a thickness of approximately a 1000 angstroms and with openings of 20–50 micrometers in diameter and center-to-center spacings of 80–180 micrometers. The permanent mandrel 60 shown in FIG. 3A is transferred to an electroplating deposition station wherein a thick metal layer 68 such as nickel is plated in the convergent geometry shown in FIG. 3B on the top of the copper pattern 64 and down over the edges 66 thereof and into a point of contact 70 with the upper surface of the polyimide substrate layer 62.

The composite orifice plate structure shown in FIG. 3B is then transferred to another materials processing station where the polyimide material in the region 72 of the layer 62 and bounded by the sidewall boundaries 74 is removed such as by the use of a laser ablating process. One such process is described in an article by Poulin and Eisele entitled "Advances in Excimer Laser Materials Processing", *SPIE Proceedings*, Volume 998, page 84, Lumonocs Press, September 1988. This step further extends the orifice bore dimension and convergent contour of the previously formed orifice openings 76 in the metal layer 68 down along the aligned sidewalls 74 of the opening 72 in the polyimide material 62. In this manner, the output ink ejection orifice opening of the thus formed structure is now located at the circular exit opening or hole 78 in the polyimide layer 62. The polyimide layer 62 will typically be on the order of about 25 micrometers in thickness, whereas the metal electroplated layer 68 will typically be on the order of about 50 micrometers in thickness to bring the total composite layer thickness of the orifice plate structure shown in FIG. 3C to a value on the order of 75 micrometers or greater.

The provision of a composite orifice plate of the type described and having an outer polyimide layer as shown in FIG. 3C has several attendant advantages. First, the polyimide orifice plate material has a non-wetting surface which impedes the build-up of ink thereon, thus impeding ink spray and providing repeatable drop trajectories. Secondly, the interior surfaces of the polyimide materials may be rendered wettable by the use of laser ablation, thereby enhancing orifice refill and bubble purging characteristics while impeding bubble ingestion and enhancing the high frequency stable operation of the orifice plate. Thirdly, the polyimide material provides for the ease of manufacturability as a result of its reel-to-reel processing capability.

Various modifications may be made in and to the above described embodiments without departing from the spirit and scope of this invention. For example, the invention described above is not limited to either the particular metals used in the mandrels described or those metals used in the formation of the electroplated metal orifice plates. Reusable mandrels comprising metal substrates having selected insulating patterns formed thereon such as those described in the above identified U.S. Pat. No. 4,773,971 and application Ser. No. 07/236,890 to Si Ty Lam et al may be used instead of the specifically described metal-on-insulator mandrels in the above three embodiments of the invention. In addition, the nickel orifice plates described above may be further treated such as by the use of gold plating techniques to plate the surfaces of the metal orifice layers with gold after the orifice or nozzle plate structures have been completed as described. Also, if greater orifice plate thicknesses are required for any of the above described embodiments, additional layers of metal may be electroplated as described above with reference to FIGS. 1A–1E.

Accordingly, the above and other design and process modifications available to those skilled in the art are within the scope of the following appended claims.

We claim:

1. A process for manufacturing orifice plates for use in inkjet pens and having an improved orifice plate thickness and convergent bore geometry, comprising the steps of:

a. providing a mandrel having a surface area thereon comprised of metallic and non-metallic regions, b. electroforming a first metal layer on said mandrel surface area and on said conductive regions thereon and extending over the edges of said non-metallic regions of said mandrel to form convergent orifice openings located on top of said non-metallic regions, c. forming an insulating pattern on top of said first metal layer so that insulating sections or islands within said insulating pattern overlie and are approximately laterally coextensive with said non-metallic regions of said mandrel, and d. electroforming a second metal layer on top of said first metal layer and extending over the edges of said insulating section or islands of said insulating pattern to form convergent orifice openings within said second metal layer which are aligned with said convergent orifice openings in said first metal layer, whereby the aligned convergent orifice openings in said first and second metal layers preserve the integrity of and form an overall convergent orifice opening contour and geometry extending from an outer surface of said first metal layer to an outer surface of said second metal layer.

2. The process defined in claim 1 wherein said non-metallic regions of said mandrel are formed of a selected inorganic dielectric material, said insulating pattern formed on top of said first metal layer is photoresist, and said first and second layers of metal are electroplated nickel.

3. The process defined in claim 2 wherein said reusable mandrel is fabricated by first depositing a stainless steel layer on an insulating substrate, and then forming a pattern of silicon carbide on said stainless steel layer.

4. An article of manufacture fabricated by the process defined in claim 1 above.

5. A process for manufacturing orifice plates for use in inkjet pens and having an improved orifice plate thickness and convergent bore geometry, comprising the steps of:

a. providing a mandrel having a surface area thereon comprised of conductive and insulating regions, b. electroplating a metal layer on the surface of said conductive regions of said mandrel and over the edges of said insulating regions to thereby form convergent orifice openings atop said insulating regions of said mandrel, and c. anisotropically plating said metal layer at a vertical or layer thickness rate which is greater than the plating rate in the lateral direction or dimension perpendicular to said vertical or thickness dimension, whereby metal orifice plate layer thicknesses on the order of 75 micrometers or greater may be achieved simultaneously with the production of convergent orifice opening geometries in the metal layer thus formed.

6. The process defined in claim 5 wherein said mandrel is formed by first depositing a layer of stainless steel on an insulating substrate, and then forming an inorganic dielectric pattern such as silicon carbide on said stainless steel layer, and further wherein said metal layer is electroplated nickel.

7. The article of manufacture fabricated by the process defined in claim 5 above.

8. A process for manufacturing orifice plates for use in inkjet pens and having an improved orifice plate thickness and convergent bore geometry comprising the steps of:

a. providing an insulating substrate having a metal pattern thereon, b. electroplating a metal over the surfaces of said metal pattern and over into contact with an exposed surface of said insulating substrate to form convergent orifice openings in said metal layer terminating on said insulating substrate, and c. providing openings in said insulating substrate which are aligned with said convergent orifice openings in said metal orifice plate layer to thereby extend the orifice opening convergence and contour of said metal orifice plate layer from one side of said insulating substrate to the other, whereby said insulating substrate is left permanently in place adjacent to said metal orifice plate layer to thereby form a composite metal-insulator orifice plate structure capable of a total thickness on the order of about 75 micrometers or greater.

9. The process defined in claim 8 wherein said insulating substrate is formed of a polyimide material which has a non-wetting outer surface operative to impede the build up of ink thereon, thereby also impeding ink spray and providing repeatable drop trajectories, with the interior surfaces of said polyimide material being treatable by laser ablation to render these interior surfaces wettable to enhance the high frequency stable operation of said orifice plates.

10. The process defined in claim 8 wherein said insulating substrate is formed of a polyimide material, said metal pattern deposited on said polyimide material is copper, and said metal orifice plate layer is electroplated nickel.

11. The article of manufacture fabricated by the process defined in claim 8 above.

* * * * *